US006634260B1

(12) United States Patent
Smith

(10) Patent No.: US 6,634,260 B1
(45) Date of Patent: Oct. 21, 2003

(54) ANCHORED AND SCREW ASSISTED WRENCH TOOL

(76) Inventor: Jonathan R Smith, 714 Plantation Cir., Brunswick, GA (US) 31525

( * ) Notice: Subject to any disclaimer, the term of this patent is extended or adjusted under 35 U.S.C. 154(b) by 152 days.

(21) Appl. No.: 10/045,126

(22) Filed: Oct. 26, 2001

Related U.S. Application Data

(60) Provisional application No. 60/244,873, filed on Nov. 2, 2000.

(51) Int. Cl.[7] ..... B25B 13/50
(52) U.S. Cl. ..... 81/57.36; 81/55; 81/462
(58) Field of Search ..... 81/57.24, 57.29, 81/57.36, 57.4, 462, 13, 52, 55

(56) References Cited

U.S. PATENT DOCUMENTS 1,245,921 A * 11/1917 Holdren ..... 81/57.29
4,274,310 A * 6/1981 Michaud ..... 81/57.3
5,074,170 A * 12/1991 Shirley ..... 81/57.3
5,179,876 A * 1/1993 Gadea Mantilla ..... 81/57.3
5,499,554 A * 3/1996 Ilyes ..... 81/55
5,546,833 A * 8/1996 Holdeman et al. ..... 81/52
5,775,183 A * 7/1998 Tavianini ..... 81/55
6,330,845 B1 * 12/2001 Meulink ..... 81/462

* cited by examiner

*Primary Examiner*—James G. Smith
(74) *Attorney, Agent, or Firm*—Rigdon Patents & Engineering, P.C.; Jonathan R. Smith

(57) ABSTRACT

A tool for adjusting extremely tight lug nuts, such as often found on tractor-trailer trucks, consists of a socket wrench pulled by a screw and anchored against another lug nut coaxial to the one being adjusted. A hand crank turns the screw, which in turn pulls the handle of the socket wrench toward the anchor yielding very high torque multiplication. The tool is elongated and shaped to permit its use in the tight space found in the annular recess surrounding the hubs of most truck wheels.

14 Claims, 14 Drawing Sheets

ANCHORED AND SCREW ASSISTED WRENCH TOOL

PRIORITY CLAIM

This nonprovisional application for patent claims priority of copending provisional application No. 60/244,873 filed Nov. 2, 2000.

BACKGROUND OF THE INVENTION

For safety reasons, it has been desirable to fasten truck wheel lug nuts with power tools (e.g., pneumatic drivers) that can deliver higher torques than have been obtainable by hand. As a result of this need for power assistance in tightening, a power driver is required any time a tire needs to be removed or the tightness of a nut needs to be checked or adjusted. This means that such work must be done in a service center, or, in the event of a roadside emergency, by either a roadside service vehicle or an on-board power driver if available. However, roadside service is expensive and time-consuming, and sufficiently powerful on-board equipment is expensive. A need exists for a lower cost alternative.

The lower cost alternatives are often manual tools. However, the use of manual tools on truck wheels is complicated by the fact that most truck wheels except those on the front end have lug nuts that are recessed as much as a foot from the outer edge of the tire. If a conventional wrench or breaker bar is used with an extension enabling access to these lugs, not only does the user have to support the weight of the wrench, he also has to balance his rotational force to keep from twisting the tool off the lug nut. The present invention anchors the tool and balances the forces so that only the modest weight of the tool need be supported manually.

SUMMARY OF THE INVENTION

The present invention is a tool for tightening or loosening a fastener, the tool being anchored against reactive force to a nearby fastener or stud, and utilizing a screw to pull or push a wrench handle against the anchor. The screw increases the hand torque applied to it to levels comparable to a power driver. Further, the tool is shaped to permit its use in the tight space found in the annular recess surrounding the hubs of most truck wheels. Principal objects of the invention are to provide: a) a hand tool capable of generating the very high torques needed to adjust truck wheel lug nuts with relatively low cost, weight, and space requirements; b) a tool that can be used on a variety of lug nut configurations including both recessed nuts (such as are typically found on rear axle wheels of tractor-trailer trucks) as well as easily-accessible nuts (such as those usually found on the front wheels of truck tractors); c) a tool designed so that the active and reactive forces are collinear and the moments coaxial so that the user does not have to resist applied forces during use of the tool to keep it in place; and d) a tool designed to keep internal stresses that would reduce efficiency due to friction to a low level.

DETAILED DESCRIPTION OF THE INVENTION

Referring again to the drawings, in which like details are referenced by like numerals, a detailed description of the invention is given below.

Figure 1:
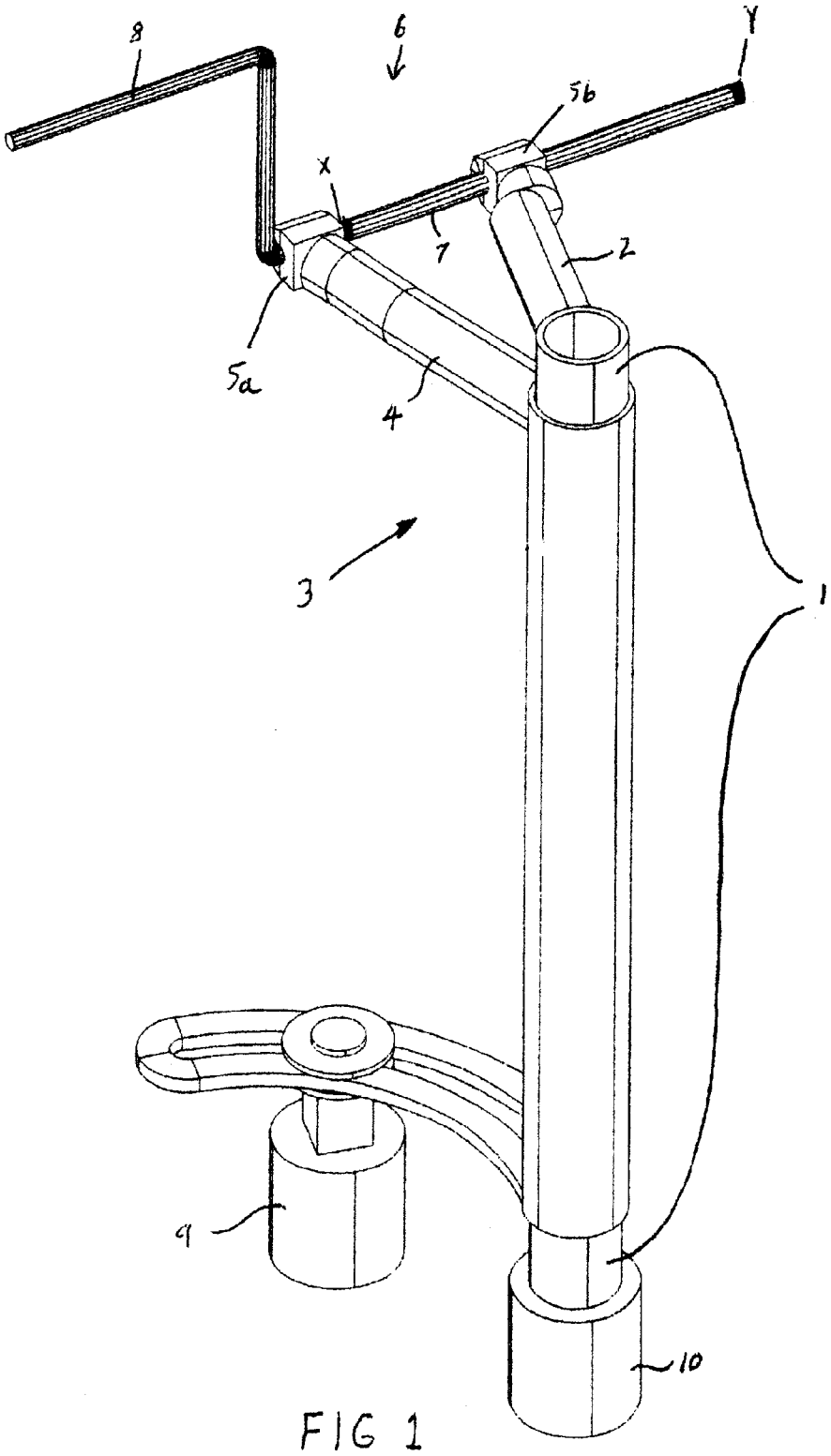
FIG. 1 is a perspective view of a first embodiment of the tool contemplated by the present invention.

FIG. 1 is a perspective view of the first embodiment of the tool contemplated by the present invention. It is an extended socket wrench, the handle of which is pulled by the action of a screw against a similarly extended and coaxial anchoring device. It comprises a wrench portion 1 having a wrench arm 2, said wrench portion cooperating slidably and coaxially with an anchor portion 3 having an anchor arm 4. The wrench arm 2 and the anchor arm 4 are gripped and moved relative to one another by an actuator assembly 6 comprising talons 5*a* and 5*b*, respectively, riding on a screw 7 that is threaded its entire length from point X to point Y. The distance between the talons is changed by rotating screw handle 8 in either direction. As oriented in FIG. 1 with threads being right handed, when the handle is rotated clockwise (toward the reader) the screw 7 pulls talon 5*b* towards talon 5*a*, thereby rotating wrench portion 1 counterclockwise within anchor portion 3. The anchor portion 3 cannot rotate clockwise in reaction to this pull because it is held in place by anchor socket 9, and so wrench socket 10 must turn counterclockwise. A small force on handle 8 is multiplied by the leverage of the arms 2 and 4 and the incline of the threads of screw 7 into a large torque at wrench socket 10. The entire actuator assembly 6 is removable from the rest of the tool. In this embodiment, the arms 2 and 4 are hollow and the talons 5*a* and 5*b* grip them by means of round teeth (not shown) inserted into the arms. The depicted means of attaching the actuator assembly 6 to the arms 2 and 4 is not intended to exclude other equally strong attachment means, such as, for example, replacing the talon teeth with drill holes capable of being slipped over the ends of the arms.

The arms 2 and 4 extend an equal distance from the common axis of portions 1 and 3. This ensures that the radial components of the forces on the arms (away from the axis of the tool) which would tend to detach the talons from the arms, are negligible. Further, the arms are bent as shown so that they interfere minimally when the talons are drawn close together by the screw. The bends in the arms also cause the plane of motion of the screw and the talons to be always normal to the common axis of portions 1 and 3, thereby ensuring that forces collinear with the tool axis (thrust forces) which would tend to disengage the tool from the work piece and/or anchor piece, are minimal. If the forces on the tool components were to be diagrammed with vectors, the diagram would show net zero resultants and moments at all points except for the weight of the tool itself.

Figure 2:
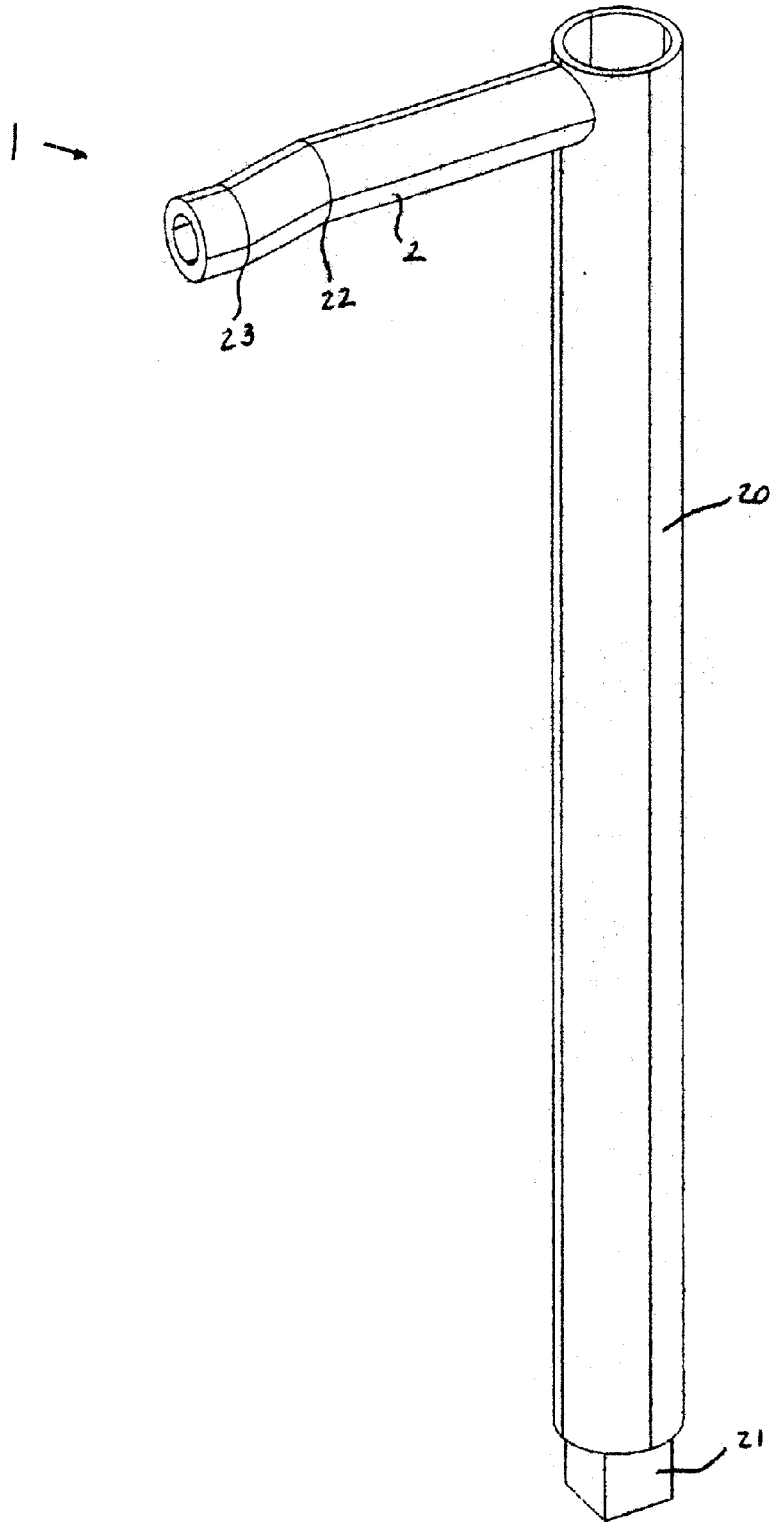
FIG. 2 is a perspective view of the wrench portion of the first embodiment.

FIG. 2 is a perspective view of the wrench portion 1 of the first embodiment. It comprises a hollow shaft 20 to which is welded a wrench arm 2 at one end and a square socket drive 21 at the other. Wrench arm 2 is angled downward and rearward slightly at 22, then upward and forward slightly at 23, to better cooperate with the anchor arm depicted in the following figure. A conventional wrench socket (not shown) is affixed to the drive 21 to grip a lug nut on a truck wheel (not shown).

Figure 3:
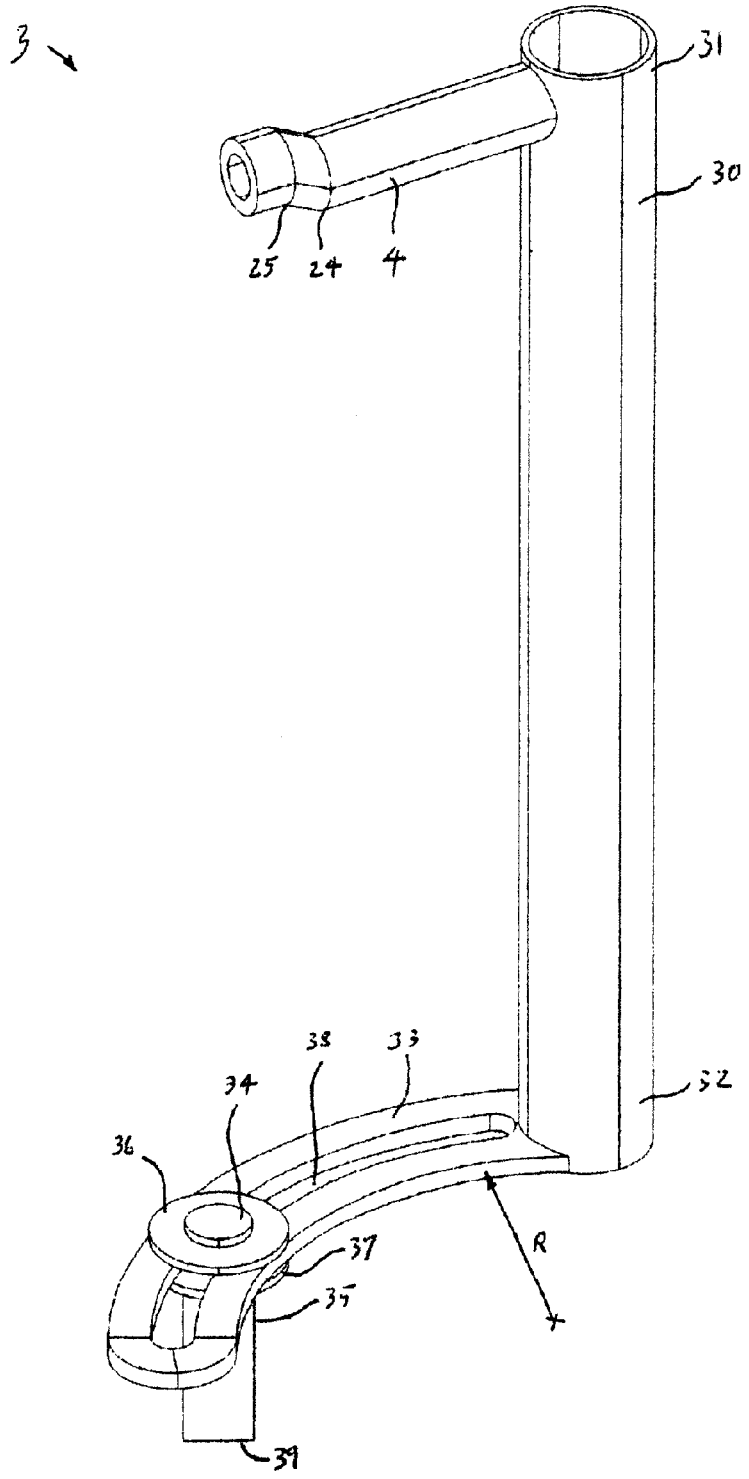
FIG. 3 is a perspective view of the anchor portion of the first embodiment.

FIG. 3 is a perspective view of the anchor portion 3 of the first embodiment. It comprises a hollow tube 30 of an inside diameter greater than the outer diameter of hollow shaft 20 in FIG. 2. Anchor arm 4 is welded to the upper end 31 of tube 30. Arm 4 is angled upward and forward slightly at 24, then downward and rearward slightly at 25, to better cooperate with the wrench arm depicted in the preceding figure, i.e., so that the ends of both arms 2 and 4 always lie in the same plane, a plane perpendicular to the axes of shaft 20 and tube 30, and so that the two arm ends can meet each other closely regardless of which way they are rotated. The depicted configuration of bends is not meant to preclude more rounded or more sharply bent arm shapes that would accomplish the same purpose.

To the lower end 32 of the tube 30 is fixedly attached a slotted guide 33. The purpose of the guide 33 is to provide an adjustable anchor point for the tool on an adjacent lug nut. The distance between lug nuts on truck wheels varies due to the size and type of hub and the number of lug nuts per wheel, so the anchor point is comprised of a lug nut socket (not shown) on the square end 39 of a movable boss 35 that rides in the slot 38 of the guide 33. The guide 33 is curved in a plane normal to the axis of tube 30, the curvature having a radius R matching that of the typical lug nut array (not shown) on a truck wheel (not shown). This is helpful in the event the lug nuts are recessed into a narrow annular space around the hub of the wheel, as they often are; the width of the guide 33 and its attached parts is narrow enough to fit into the annular space containing the lug nuts. A bolt 34 is screwed into a square boss 35 through washer 36, guide 33 and washer 37 without compressing the washers against the guide, so that the boss 35 can ride slidably along the guide 33 and rotate freely on an axis parallel to the axis of tube 30. Boss 35 has a square end 39 identical to socket drive 21 of FIG. 2, so that identical and interchangeable sockets can be used on both the anchor piece and the work piece. The guide 33 and the washers 36 and 37 are wide in a direction normal to the axis of tube 30 so that when the boss 35 is pushed sideways by reactive torque during operation of the tool, the axis of boss 35 is kept parallel to the tool axis, reducing any tendency of the tool to twist loose from either the work piece or the anchor piece during use. The square end of boss 35 accommodates a conventional wrench socket (not shown) identical to that applied to the wrench shaft 20 of FIG. 2 which grips the anchor piece, typically another lug nut (not shown) on the same truck wheel.

Figure 4:
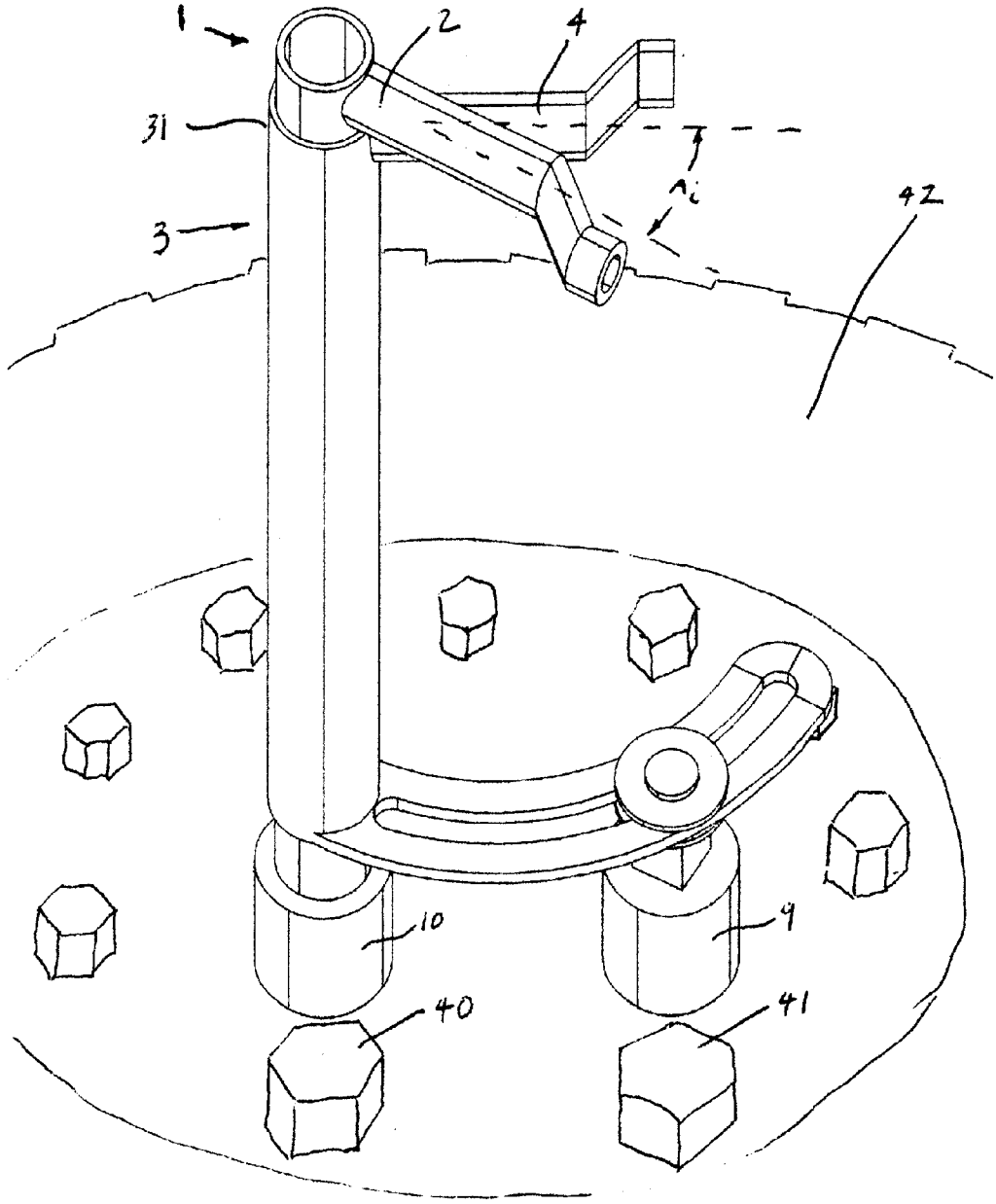
FIG. 4 is a perspective view of the first embodiment about to be applied to a work piece and an anchor piece on a typical truck wheel.

FIG. 4 is a perspective view of the wrench portion 1 and the anchor portion 3 of the first embodiment assembled together coaxially and ready for application to a work piece 40 and an anchor piece 41 on a typical truck wheel 42. Assembly is accomplished by sliding the square drive end of portion 1 into the upper end 31 of portion 3 until the wrench arm 2 comes in contact with upper end 31. When applied to a wheel, the direction of anchor arm 4 will be toward whichever lug nut or stud is to be used as the anchor piece 41 for the tool. The orientation of wrench arm 2 about the tool axis may be any one of N directions for an N-sided socket applied to a work piece consisting of an N-sided lug nut. (N is typically six.) Out of these N directions, the user must choose the direction that will put the ends of the arms as far apart as they can be yet still be gripped by talons 5*a* and 5*b* on actuator assembly 6 (FIG. 1). Screw 7 of FIG. 1 should be long enough to span the ends of the arms 2 and 4 when the initial angle Ai between them, in their plane of revolution, is as large as about 110 degrees.

Figure 5:
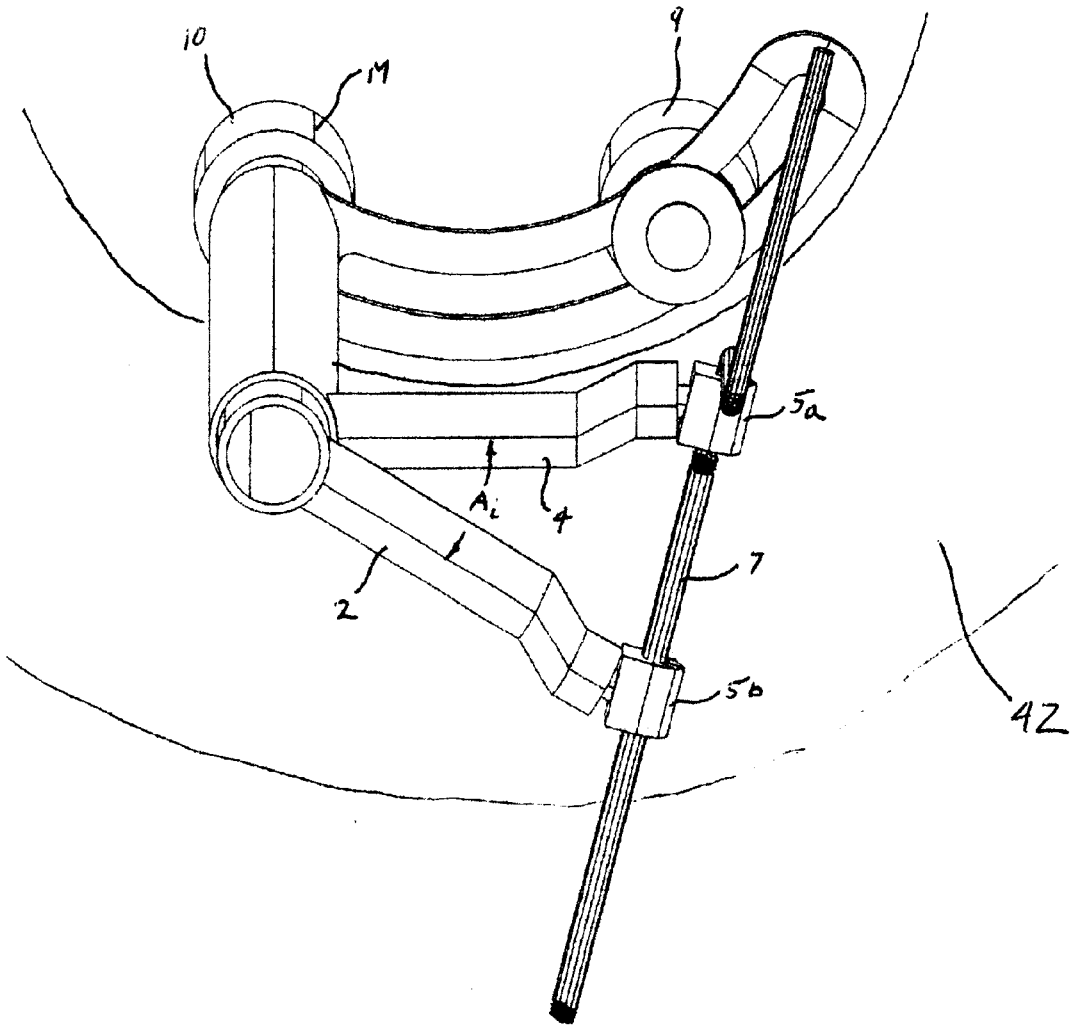
FIG. 5 is a view of the first embodiment from the viewpoint of a user when applied to a work piece and an anchor piece before the work piece is loosened.

FIG. 5 is a view of the first embodiment from the viewpoint of a user when applied to a work piece (hidden under socket 10) and an anchor piece (hidden under socket 9) on truck wheel 42 before the work piece is loosened. Actuator assembly 6 may be put in place by rotating talon 5*b* around the threads of screw 7 (or rotating screw 7 within talon 5*b*) until the distance between the talons is such that the talon teeth (not shown) can be inserted into the ends of arms 2 and 4. Note the position of mark M on the side of wrench socket 10, and the initial angle Ai between arms 2 and 4.

Figure 6:
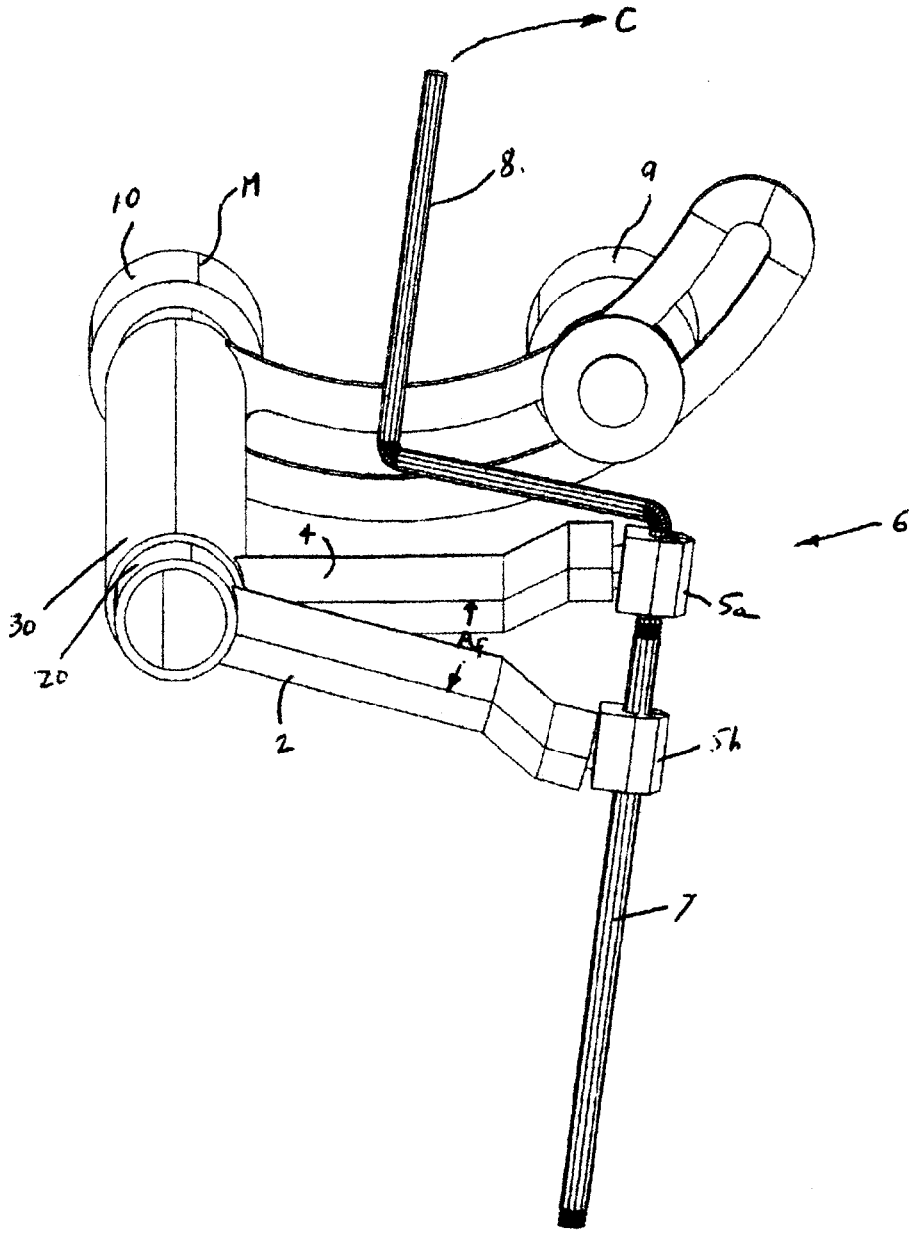
FIG. 6 is a view of the first embodiment from the viewpoint of a user when applied to a work piece and an anchor piece after the work piece is loosened.

FIG. 6 is a view of the first embodiment from the viewpoint of a user when applied to the same work piece and anchor piece after the work piece is loosened. Assuming right-handedness on all threads, handle 8 on actuator assembly 6 has been rotated in direction C (into the drawing) a number of times, drawing talon 5*b* closer to talon 5*a* and reducing angle Ai in FIG. 5 between arms 2 and 4 to angle Af This has caused shaft 20 to rotate counterclockwise within tube 30 a small amount, in turn forcing wrench socket 10 to rotate in a counterclockwise direction as well. This is clear from the fact that mark M on socket 50 in this figure has been displaced to the left of its position in FIG. 5. Only a few degrees of motion should be necessary in most cases to loosen a work piece to a degree sufficient to enable complete removal by hand or conventional lug wrench after the talons 5 have been drawn fully together. In the event further loosening is required, it is necessary for the user to remove the actuator assembly 6 (to the right in this figure) from the arms 2 and 4, re-orient the wrench portion 1 one "flat" clockwise on the work piece, wind talon 5*b* away from talon 5*a* on screw 7, reapply the actuator assembly to the arms, and turn the handle in direction C again.

Figure 7:
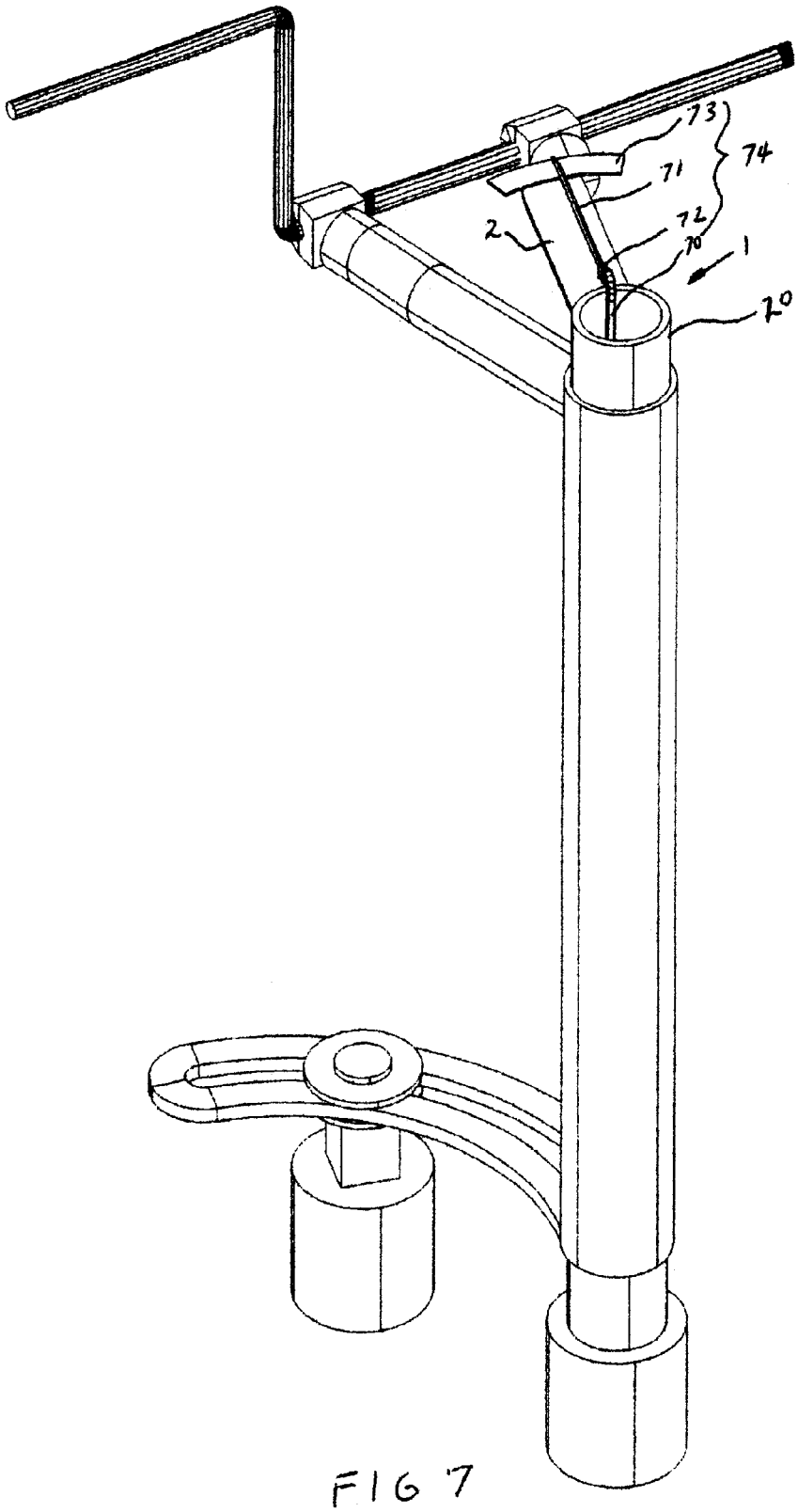
FIG. 7 is a perspective view of the first embodiment with an added torque indicator assembly.

FIG. 7 is a perspective view of the first embodiment completely assembled as in FIG. 6, but with an added torque indicator assembly 74 comprising a rod 70, a pointer 71, a pivot 72 and a scale 73 attached to the shaft 20 and arm 2 of wrench portion 1.

Figure 8:
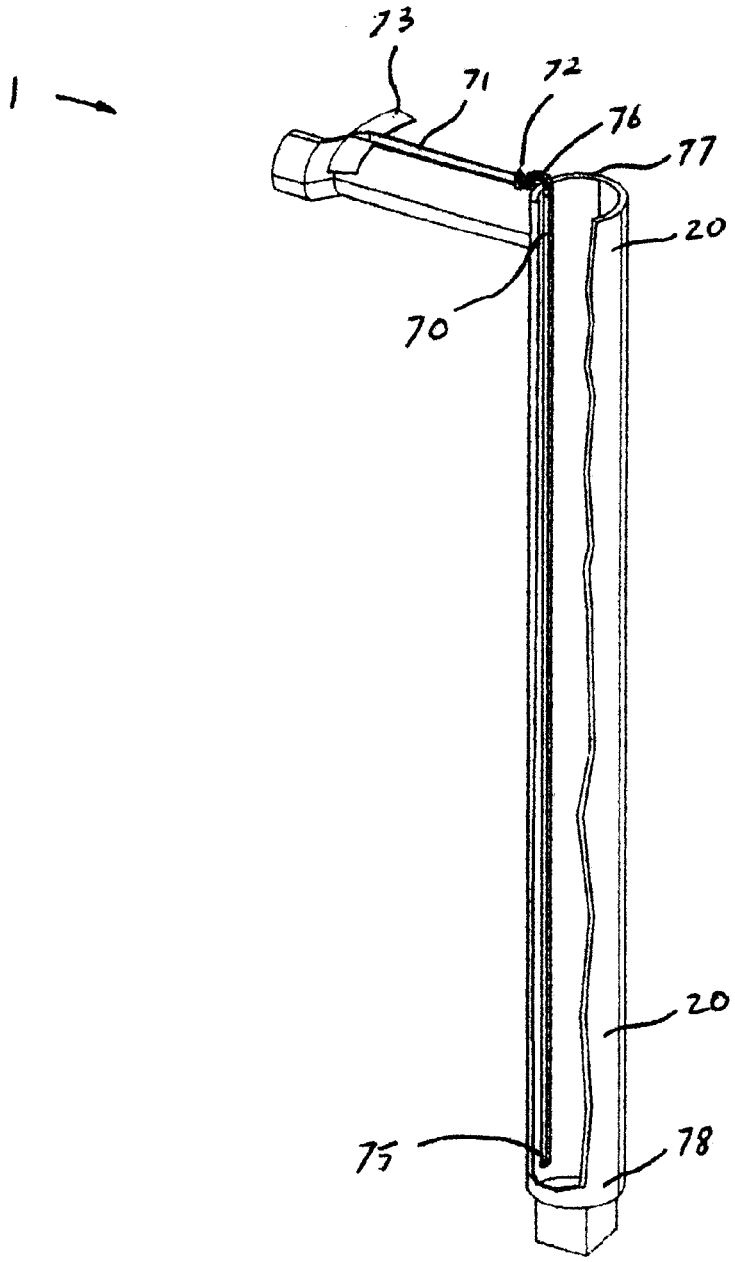
FIG. 8 is a cutaway perspective view of the first embodiment with an added torque indicator assembly.

FIG. 8 is a cutaway perspective view of the first embodiment with the added mechanical torque indicator of FIG. 7. The cutaway is necessary to show that the rod 70 extends all the way to the bottom end 78 of hollow shaft 20. The lower end 75 of rod 70 is rigidly attached to the inside of the bottom end 78 of hollow shaft 20. The upper end 76 of rod 70 curves over the top edge 77 of shaft 20 and flexibly engages pointer 71, as is more clearly shown in FIGS. 9 and 10. Pivot 72 and scale 73 are fixedly attached to arm 2.

Figure 9:
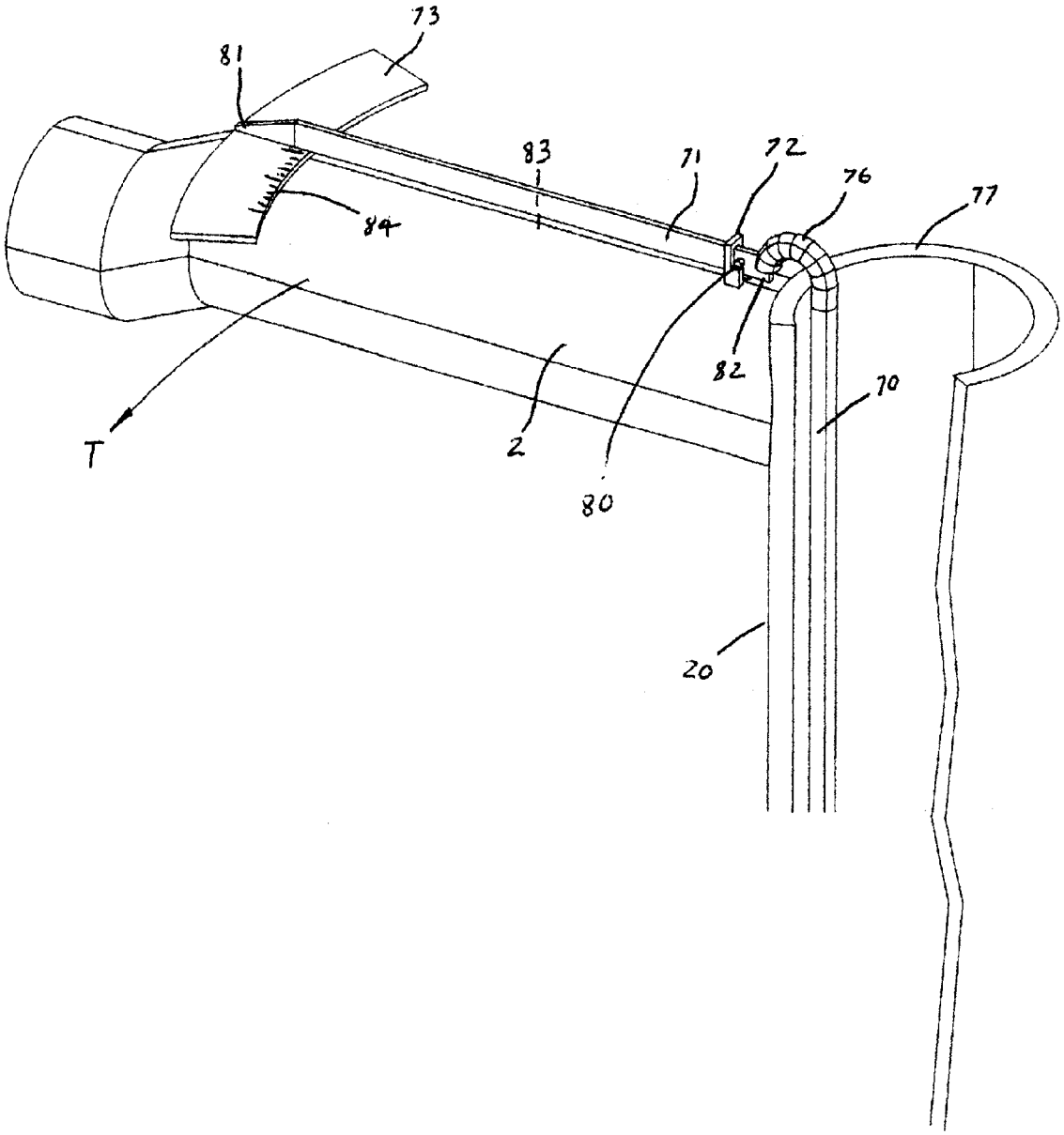
FIG. 9 is a close-up cutaway perspective view of the upper portion of the torque indicator assembly.

FIG. 9 is a close-up cutaway perspective view of the upper portion of the mechanical torque indicator of FIG. 7, more clearly showing how pin 80 through pointer 71 rests slidably on pivot 72. When wrench arm 2 is pulled toward the viewer in an attempt to loosen a lug nut engaged by drive 21 on the bottom of shaft 20 (not visible), the arm 2 will apply a counterclockwise torque on shaft 20 as indicated by arrow T. This torque will cause the top edge 77 of shaft 20, as well as arm 2, pivot 72, and scale 73, to be displaced in a counterclockwise direction relative to the bottom of the shaft (not shown) because of the elasticity of the material in the shaft. The curved upper end 76 of the indicator rod 70, however, because it is rigidly attached to the bottom of the shaft, tends not to move with the upper end of shaft 20 and attached parts. The upper end 76 of rod 70 tends therefore to prevent the inner end 82 of pointer 71 from moving counterclockwise. Because the pivot 72 is also moving counterclockwise with arm 2, it tends to rotate pointer 71 counterclockwise about pivot 72, causing the tip 81 of the pointer 71 to move in a counterclockwise direction. Because pivot 72 is much closer to the upper edge 77 of the shaft 20 than the center 83 of the pointer 71, The counterclockwise motion of pointer tip 81 is magnified relative to the counterclockwise rotation of arm 2 and scale 73, so that tip 81 will move visibly over the scale 73 toward the viewer in this drawing. All of these displacements will be proportional to the applied torque, and as long as the elastic limit of the shaft material is not exceeded, they will also be reproducible. Therefore, indicia 84 may be placed on the scale 73 in units of torque to indicate replicable torque readings. Such readings may be of use in preventing the hazard of over- or under-tightening fasteners.

Figure 10:
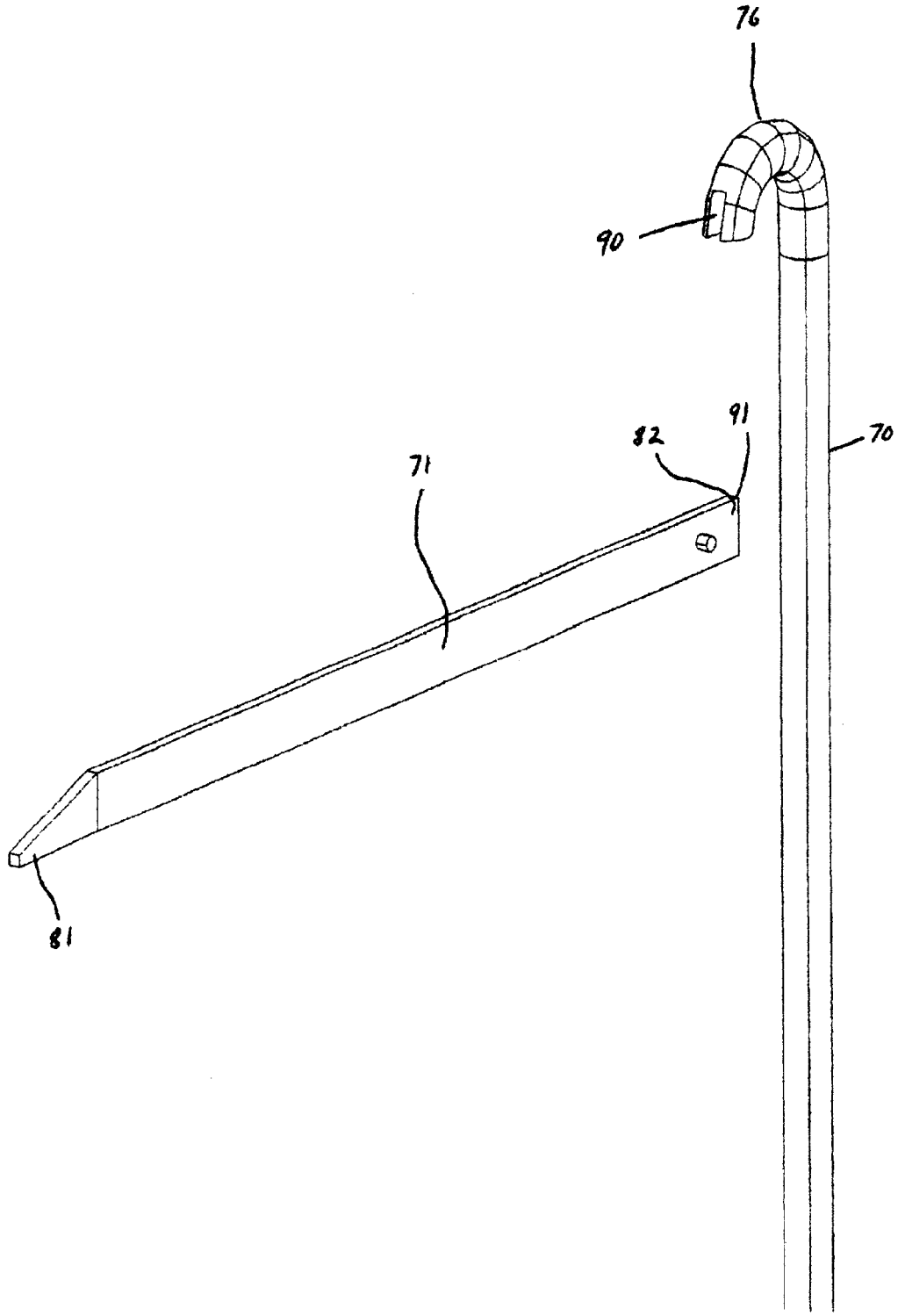
FIG. 10 is a perspective view from the left showing a simple configuration for engaging the two parts of the torque indicator assembly.

FIG. 10 is a close-up perspective view of the mechanical torque indicator from the left showing a simple means of flexibly engaging inner end 82 of pointer 71 with upper end 76 of rod 70. A slot 90 formed into end 76 fits slidably over the upper comer 91 of inner end 82 so that rod 70 can push end 82 from side to side as torque in either direction is applied to the tool. This motion in turn causes a magnified and opposite side to side motion in the opposite end 81 of pointer 71.

Figure 11:
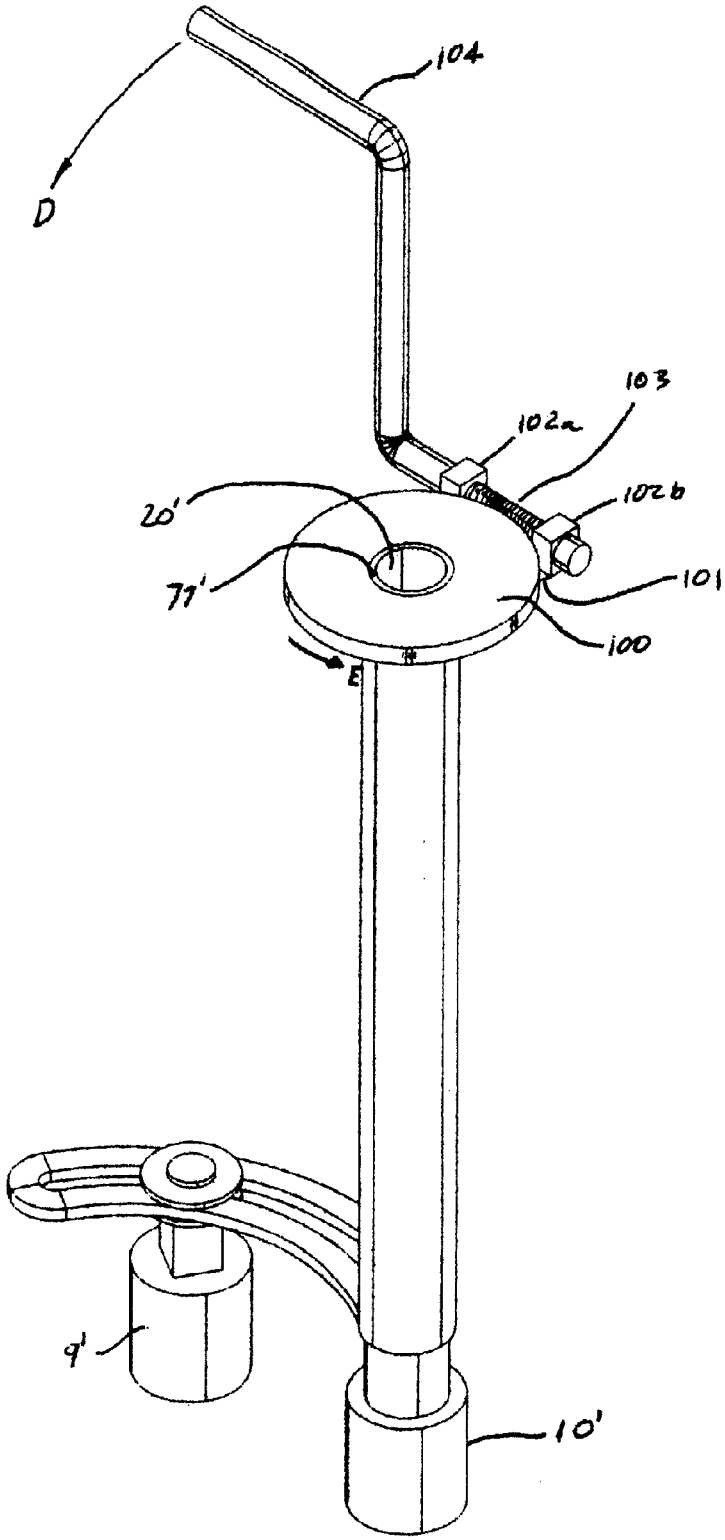
FIG. 11 is a perspective view of a second (preferred) embodiment of the tool contemplated by the present invention.

FIG. 11 is a perspective view of a second embodiment of the tool contemplated by the present invention. In the following figures, parts of the second embodiment corresponding to parts of the first embodiment are indicated by a prime (') after the numeral. The second embodiment differs from the first in that: a) arm 2 of the preceding figures is replaced by driven gear 100 which is toothed around its entire periphery and is rigidly attached to the upper edge 77 of shaft 20 (now 77' and 20', respectively); b) arm 4 is shortened and comprises a worm gear bearing 101. Bearing 101 comprises journals 102*a* and 102*b*, which hold a worm gear 103 which is turned by, and is fixedly engaged to, a handle 104. The worm gear 103, handle 104, and bearing 101 and journals 102 replace the screw 7, handle 8 and talons 5 shown in FIG. 1. If The worm gear 103 has right-handed threads, it will engage the teeth of driven gear 100 such that when handle 104 is turned in direction D, the driven gear will turn in direction E, rotating shaft 20', socket 10', and a work piece (not shown) in the same direction. By suitably sizing the gears, arms and handle, sufficiently high mechanical advantage can be achieved to loosen the tightest fasteners with moderate manual pressure.

Figure 12:
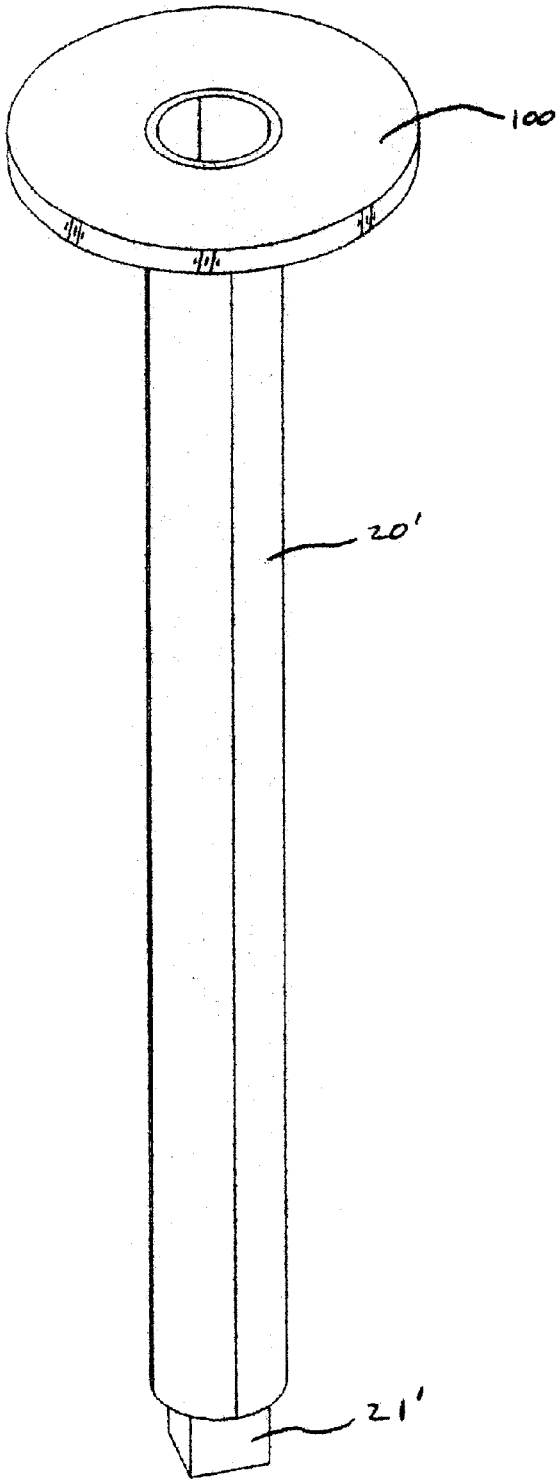
FIG. 12 is a perspective view of the wrench portion of the second embodiment.

FIG. 12 is a perspective view of the wrench portion 1' of the second embodiment, comprising shaft 20', square drive 21', and driven gear 100.

Figure 13:
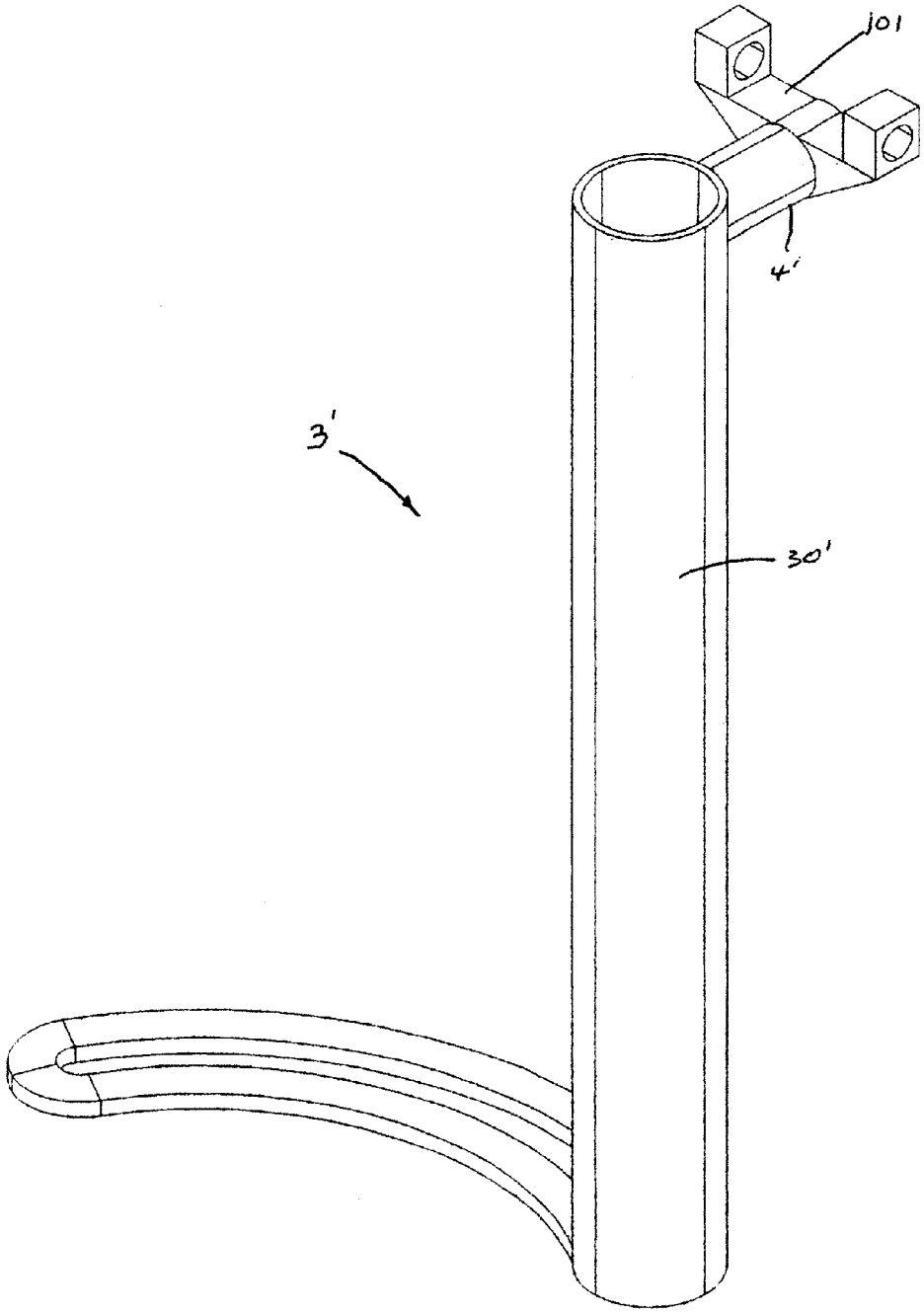
FIG. 13 is a perspective view of the anchor portion of the second embodiment.

FIG. 13 is a perspective view of the anchor portion 3' of the second embodiment, comprising tube 30', a shortened anchor arm 4', and worm gear bearing 101 welded to arm 4'. The remaining parts of the anchor portion of the second embodiment are the same as those of the first embodiment.

Figure 14:
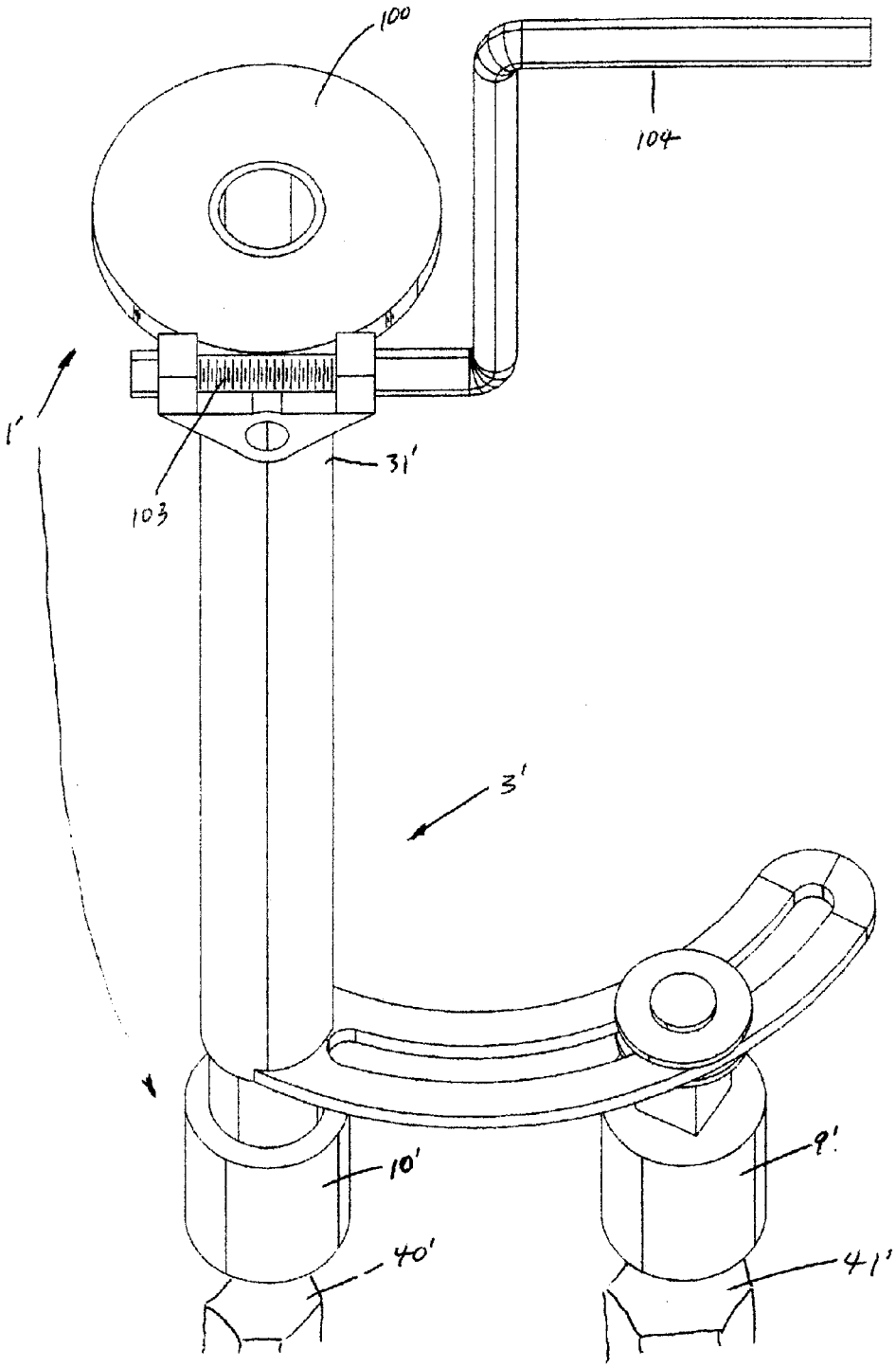
FIG. 14 is a perspective view of the second embodiment about to be applied to a work piece and an anchor piece on a typical truck wheel.

FIG. 14 is a perspective view of the wrench portion 1' and the anchor portion 3' of the second embodiment assembled together coaxially and ready for application to a work piece 40 and an anchor piece 41 on a typical truck wheel. Assembly and positioning are accomplished first by sliding the square drive end of the wrench portion 1' into the upper end 31' of anchor portion 3', and attaching wrench socket 10' and anchor socket 9' to the square drive (hidden) and anchor boss (hidden) respectively; second, by placing the anchor socket 9' over anchor piece 41' on a wheel next to whichever work piece 40' it is desired to loosen; and third, by placing the wrench socket 10' over the selected work piece 40'. It may be necessary to turn the driven gear 100 by hand prior to meshing the driven gear 100 and the worm gear 103, or by meshing these gears and then turning handle 104 in either direction, to cause the wrench socket 10' to fit over the work piece 40'. The work piece 40' can then be loosened or removed completely, without removing the tool from the wheel, by turning handle 104 as many revolutions as required.

Although not specifically illustrated, the torque indicator portion of the first embodiment may also be incorporated readily into the second embodiment by affixing the pivot 72 and the scale 73 of FIG. 7 to the upper surface of the driven gear 100 of FIG. 11, the rest of the assembly being identical to that shown in FIG. 8. Further, it is noted that similar mechanical torque indicating devices may be attached alternatively to anchor portion 3. Still further it is noted that in either of the embodiments, an electronic strain gauge may be attached to any one of various stressed parts of this tool, instead of mechanical indicator parts, such that an analog or digital readout of torque could be displayed at a convenient spot on the tool. For example, a strain bridge could be attached to the inner.wall of wrench shaft 20 or 20', energized by a small battery and readable by a potentiometer installed in the shaft and displayed on an LCD mounted on top of the shaft.

In light of the drawing descriptions, the differences between these two embodiments can be summarized by saying that the first embodiment may be less expensive than the second to fabricate, because it does not comprise gears and does not require the small manufacturing and assembly tolerances necessary for smooth and efficient meshing of the gears. The advantage of the second embodiment is one of convenience, in that the loosening process can be extended to the point of complete removal of the fastener, if desired, without repositioning parts of the tool.

This invention contemplates a third embodiment, not illustrated, in which a pipe wrench is employed in place of wrench arm 2 in the first embodiment. The jaws of the pipe wrench are placed around that section of shaft 20 protruding above tube 30 so that they grip the shaft when the handle of the pipe wrench is pulled in the fastener-loosening direction. A screw-operated actuator assembly capable of gripping the handle of the pipe wrench and the end of anchor arm 4 similar to assembly 6 shown in the illustrations of the first embodiment is used to pull the handle of the pipe wrench toward anchor arm 4. A common c-clamp or bar clamp with its ends adapted to hold securely the handle of the pipe wrench and the end of anchor arm 4 serves the purpose of an actuator for this third embodiment of the tool. The advantage to this embodiment over the first two might be cost if a suitable pipe wrench and clamp are available.

I claim:

1. A wrench tool, comprising:

a first elongate member and a second elongate member, each member comprising a top end, an axis, and a bottom end, the second elongate member being hollow throughout its length and containing the first elongate member in coaxial relationship;

the first elongate member further comprising at its top end a first torque receiving means fixed rigidly thereto for receiving a rotational torque about its axis, and further comprising at its bottom end a first means for gripping a fastener, the first fastener gripping means being coaxial to the first elongate member;

the second elongate member further comprising at its top end a second torque receiving means fixed rigidly thereto for receiving a rotational torque about its axis, and further comprising, at its bottom end, anchoring means for anchoring the second elongate member against rotation;

the wrench tool further comprising pulling means interposed between the first torque receiving means and the second torque receiving means, so that actuation of the pulling means causes application of equal and opposite torque to the first and second torque receiving means, respectively, tending to rotate the first elongate member and the first fastener gripping means relative to the second elongate member and the anchoring means, about their common axis.

2. The wrench tool of claim 1 wherein:

said anchoring means comprises an elongate guide having a proximal and a distal end, the proximal end fixed to said bottom end of said second elongate member and the distal end displaced away from said bottom end in a plane perpendicular to said common axis;

the guide further comprising holding means for a second fastener gripping means at a distance from said common axis intermediate between the proximal and distal ends, the second fastener gripping means also lying in a plane passing through said first fastener gripping means, the plane also being perpendicular to said common axis.

3. The wrench tool of claim 2 wherein:

said guide further comprises a top face and a bottom face, both in planes perpendicular to said common axis, each face having a centerline running from said proximal end to said distal end; and said holding means further comprises a) a slot cut through the guide from one face to the other along the centerline, and b) a pin extending through the slot and slidable along the slot, the pin further comprising an upper end and a lower end, an axis parallel to said common axis, a retaining means wider than the slot at the upper end, and an attachment means for said second fastener gripping means at the lower end.

4. The wrench tool of claim 3 wherein:

said first torque receiving means comprises a wrench arm having an inner end and an outer end, the inner end of the wrench arm rigidly fixed to said top end of said first elongate member, and the outer end of the wrench arm extending substantially normal to said common axis and further comprising a first engagement means;

said second torque receiving means comprises an anchor arm having an inner end and an outer end, the inner end of the anchor arm rigidly fixed to said top end of said second elongate member, the outer end of the anchor arm extending substantially normal to said common axis and further comprising a second engagement means;

said pulling means comprises a male threaded rod having a turning means disposed at one end and axle means disposed at the other end, a first puller tapped through with female threads to fit the rod and screwed onto the rod, and a second puller bored through to fit the axle means; and the first puller is engaged to the first engagement means, the second puller is engaged to the second engagement means, so that when torque is applied to the turning means, the threads revolve, moving the first puller relative to the second puller.

5. The wrench tool of claim 3 wherein:

said first torque receiving means comprises a peripherally-toothed gear rigidly and coaxially fixed to said top end of said first elongate member so that the plane of the periphery of the gear is normal to said common axis;

said second torque receiving means comprises an arm having an inner end and an outer end, the inner end of the arm rigidly fixed to said top end of said second elongate member, the outer end of the arm extending substantially normal to, and away from, said common axis and further comprising a worm gear bearing;

said pulling means comprises a worm gear having a turning means disposed at one end;

the worm gear being held by the worm gear bearing in tangential engagement with the peripherally toothed gear, so that when torque is applied to the turning means, the worm gear drives the peripherally toothed gear about the common axis.

6. The wrench tool of claim 3 wherein:

said first torque receiving means further comprises a pipe wrench having jaws and a handle, the pipe wrench being fixed to said first elongate member by application of the jaws to said top end of said first elongate member; and said pulling means further comprises a threaded clamp having two opposing clamping means having an adjustable distance therebetween, which when the clamp is interposed between the handle of the pipe wrench and said second torque receiving means, causes application of equal and opposite torque to the handle of the pipe wrench and said second torque receiving means.

7. A lug nut turning tool comprising:

a wrench portion, an anchor portion, and a detachable wrench puller;

the wrench portion comprising a straight elongated member of circular cross-section, having a first axis, a top end, and a bottom end, having affixed at its bottom end a socket drive and having affixed at its top end a wrench arm, the wrench arm having a proximal and a distal end, the wrench arm being fixed by its proximal end to the top end of the member and extending outward from the member substantially at right angles to the first axis;

the anchor portion comprising a straight elongated tube of circular inside cross-section, the tube having a second axis, an upper end, and a lower end, and having fixed to its lower end an elongate planar anchor guide, the guide having an inner end and an outer end, the inner end fixed to the lower end of the tube and its plane being perpendicular to the second axis, and the guide being slotted along its centerline, an anchor socket pin extending through the slot, and slidable within the slot in the plane of the anchor guide, the socket pin further comprising means to retain it vertically within the slot, a downward-facing anchor socket drive affixed to the bottom of the socket pin, and an anchor arm having a near end and a far end, the anchor arm being affixed by its near end to the upper end of the tube and extending outward from the tube substantially at right angles to the second axis;

the wrench portion slidingly fitted within, and having a common axis with, the anchor portion, the lengths of the wrench arm and the anchor arm being substantially equal;

the wrench arm and the anchor arm being bent so that the distal end of the wrench arm and the far end of the anchor arm lie in a plane perpendicular to the common axis;

the wrench puller comprising a first talon and a second talon rotatably engaged to a screw, the talons being shaped with engagement means on their outer surfaces to engage the distal wrench arm end and the far anchor arm end, irrespectively;

the screw comprising a threaded rod with a hand crank on one rod end and, on the other rod end, a short smooth cylindrical axle and a talon retaining means;

the first talon comprising a block tapped with a threaded bore to fit the threads on the rod and screwed onto the rod;

the second talon comprising a block with a smooth bore sized to fit the axle, positioned on the axle, and prevented from sliding off the axle by the talon retaining means.

8. A tool for turning a lug nut on a wheel having a hub and a rim and plural lug nuts disposed in the annular space between the hub and the rim, comprising:

elongated hollow shaft of circular cross-section, having an inner wall, an axis, a top end, and a bottom end, slidingly fitted within, and concentric to, an elongated anchor tube of circular inside cross-section having an upper end and a lower end;

a helical gear rigidly fixed concentrically to the top end of the hollow shaft at right angles to the axis;

a bearing support rigidly fixed to the outer surface of the top end of the anchor tube, the bearing support comprising a worm gear bearing, a worm gear set in the bearing, the support being of a length and the bearing being at an orientation so as to bring the teeth of the worm gear into engagement with the helical gear teeth;

a hand crank fixedly attached to one end of the worm gear;

a first socket drive fixedly attached to the lower end of the hollow shaft, to which a socket may be attached to engage a first lug nut to be turned;

a rigid anchor piece attached to the outer surface of the bottom end of the anchor tube, the piece being curved so as to fit in the annular space between the wheel hub and the wheel rim and lying in a plane perpendicular to the common axis; and a second socket drive slidably attached to the anchor piece in parallel orientation to the first socket drive, to which a socket may be affixed to engage a second anchoring lug nut to prevent rotation of the anchor tube relative to the wheel.

9. The tool of claim 1 further comprising:

a torque indicating means mounted on the tool readable by a person using the tool.

10. The tool of claim 9 wherein:

said torque indicating means further comprises an electric strain gauge having a sensing element and a readout, the strain gauge sensing element being affixed to a surface of either a) said tube, or b) said wrench portion.

11. The tool of claim 9 herein:

said member is hollow along its centerline from said upper end to said lower end establishing an inner wall therethrough;

said torque indicating means further comprises an elongate rod having a bottom end and a top end, the bottom end being fixedly attached to the inner wall at said lower end and the top end extending freely upward parallel to said common axis through the hollow member and out the upper end of the member;

a pointer having an inner end, an intermediate point, and an outer end;

the top end of the rod being flexibly connected to the inner end of the pointer;

a pointer fulcrum fixedly attached to the upper end of said member;

the pointer flexibly attached to the pointer fulcrum at its intermediate point so as to orient the pointer perpendicular to the rod; and a scale index marked to indicate torque, mounted on said tool below the outer end of the pointer.

12. The tool of claim 8, further comprising:

a torque indicating means mounted on the tool readable by a person using the tool.

13. The tool of claim 12 wherein:

said torque indicating means further comprises an electric strain gauge having a sensing element and a readout, the strain gauge sensing element being affixed to a surface of either a) said tube, or b) said wrench portion.

14. The tool of claim 12 wherein:

said torque indicating means further comprises an elongate rod having a bottom end and a top end, the bottom end being fixedly attached to said inner wall at said lower end and the top end extending freely upward parallel to said common axis through said hollow shaft and out said upper end of said hollow shaft;

a pointer, having an inner end, an intermediate point, and an outer end;

the top end of the rod being flexibly connected to the inner end of the pointer;

a pointer fulcrum fixedly attached to said upper end of said hollow shaft;

the pointer flexibly attached to the pointer fulcrum at its intermediate point so as to orient the pointer perpendicular to the rod; and a scale index marked to indicate torque, affixed to said tool below the outer end of the pointer.

* * * * *